US007234395B2

(12) United States Patent
Förch et al.

(10) Patent No.: US 7,234,395 B2
(45) Date of Patent: Jun. 26, 2007

(54) DEVICE FOR CONVEYING A SHEET THROUGH A PRINTING MACHINE

(75) Inventors: Peter Förch, Neustadt (DE); Markus Möhringer, Weinheim (DE); Paul Nicola, Heidelberg (DE); Marius Stelter, Heidelberg (DE)

(73) Assignee: Heidelberger Druckmaschien AG, Heidelberg (DE)

( * ) Notice: Subject to any disclaimer, the term of this patent is extended or adjusted under 35 U.S.C. 154(b) by 133 days.

(21) Appl. No.: 11/010,053

(22) Filed: Dec. 10, 2004

(65) Prior Publication Data

US 2005/0126411 A1 Jun. 16, 2005

(30) Foreign Application Priority Data

Dec. 12, 2003 (DE) ..... 103 58 171

(51) Int. Cl.
*B41F 13/24* (2006.01)

(52) U.S. Cl. ..... 101/232; 101/409

(58) Field of Classification Search ..... 101/232, 101/246, 408, 409; 271/277
See application file for complete search history.

(56) References Cited

U.S. PATENT DOCUMENTS

| | | | | | |
|---|---|---|---|---|---|
| 2,911,907 | A | * | 11/1959 | Davidson | 101/137 |
| RE25,283 | E | * | 11/1962 | Yingling | 271/183 |
| 4,127,265 | A | * | 11/1978 | Wirz et al. | 271/260 |
| 4,423,677 | A | * | 1/1984 | Fischer | 101/232 |
| 4,930,414 | A | * | 6/1990 | Wirz | 101/183 |
| 4,976,420 | A | * | 12/1990 | Flensburg et al. | 270/52.28 |
| 5,431,386 | A | | 7/1995 | Blaser | 271/204 |
| 5,454,312 | A | * | 10/1995 | Helmstaedter et al. | 101/230 |
| 5,709,151 | A | * | 1/1998 | Durr et al. | 101/477 |
| 5,839,366 | A | * | 11/1998 | Schaede | 101/232 |
| 6,038,976 | A | * | 3/2000 | Helmstadter et al. | 101/410 |
| 6,089,155 | A | * | 7/2000 | Kemmerer et al. | 101/183 |
| 6,578,846 | B2 | | 6/2003 | Maul et al. | 271/277 |
| 6,739,252 | B2 | * | 5/2004 | Stephan et al. | 101/230 |
| 6,851,361 | B2 | * | 2/2005 | Gorbing et al. | 101/230 |
| 2002/0135123 | A1 | | 9/2002 | Maul et al. | 271/277 |

FOREIGN PATENT DOCUMENTS

| | | |
|---|---|---|
| DE | 36 43 915 A1 | 10/1987 |
| DE | 42 18 421 A1 | 12/1993 |
| DE | 100 14 417 A1 | 9/2001 |
| DE | 101 57 117 A1 | 5/2003 |

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

A device for conveying a sheet through a printing machine includes a cylinder, formed with a channel wherein grippers are disposed for holding the sheet at a leading edge, a chain conveyor with grippers fixed to endless chains for holding and picking up the sheet at its leading edge from the cylinder and for holding the sheet at its trailing edge, and rotating sprockets carrying the chains. An actuating device is provided for opening and closing the grippers, and a drive is provided for the cylinder and the sprockets. Gripper pads and gripper tips for the trailing-edge grippers, in opened condition of the grippers, are able to run past the cylinder. The gripper pads and tips lie underneath a path described by the sheet. The trailing-edge grippers are closable in a rotational angle region wherein the chains run off the sprockets for the cylinder.

7 Claims, 8 Drawing Sheets

DEVICE FOR CONVEYING A SHEET THROUGH A PRINTING MACHINE

BACKGROUND OF THE INVENTION

FIELD OF THE INVENTION

The invention relates to a device for conveying a sheet through a printing machine, including a cylinder, grippers disposed in a channel formed in the cylinder for holding the sheet at a leading edge thereof, a chain conveyor with grippers fixed to endless chains for holding and picking up the sheet from the cylinder at the leading edge of the sheet and for holding it at a trailing edge of the sheet, and rotating sprockets over which the chains are disposed. The conveying device further includes coaxially revolving supporting elements for the sheet, the supporting elements being disposed between the rotating sprockets and being in rolling contact with the circumferential surface of the cylinder, and coaxially revolving suction grippers provided between the sprockets for holding the sheet at the trailing edge thereof, an actuating device for opening and closing the grippers, and a drive for the cylinder and the rotating sprockets.

German Published, Non-Prosecuted Patent Application DE 100 14 417 A1, corresponding to U.S. Pat. No. 6,578,846 B2 and to U.S. Patent Application Publication No. US 2002/0135123 A1, describes a device for transporting a sheet for a rotary printing press, wherein a sheet is transferred from a cylinder to a chain gripper system. In the chain gripper system, the sheet is held at the leading edge and at the trailing edge thereof by grippers. The trailing edge grippers pick up the sheet in an exit pocket or outlet wedge between supporting surfaces that revolve with sprockets and the circumferential surface of the cylinder. Until the sheet is picked up by the trailing edge grippers, the sheet is held by suction grippers, which likewise revolve with the sprockets. The gripper tips of the trailing edge grippers lie above a path described by the sheet held on the circumferential surface of the cylinder. In order for the trailing edge grippers to pass the circumferential surface of the cylinder without collision, appropriate recesses must be provided in the circumferential surface, which calls for additional manufacturing effort.

In the sheet delivery for a printing press according to German Published, Non-Prosecuted Patent Application DE 101 57 117 A1, the sheets are picked up by a gripper system only at the leading edge of the sheets. In order to avoid the formation of waves in the sheets in the outlet region of the chains from sprockets, the radii of the pitch circles of the sprockets are formed larger than the radius of the circular path of gripper pads about the axis of the sprocket shaft. The cylinder located opposite the sprockets is recessed in the regions opposite the sprockets. One embodiment provides for the sprockets to be disposed outside the end surfaces of the impression cylinder from which a sheet is picked up.

SUMMARY OF THE INVENTION

It is accordingly an object of the invention to provide a device for conveying a sheet through a printing machine, which overcomes the hereinafore-mentioned disadvantages of the heretofore-known devices of this general type and which affords improved sheet guidance with reduced effort.

With the foregoing and other objects in view, there is provided, in accordance with the invention, a device for conveying a sheet through a printing machine. The device comprises a cylinder, grippers disposed in a channel formed in the cylinder for holding the sheet at a leading edge thereof, a chain conveyor with grippers fixed to endless chains for holding and picking up the sheet from the cylinder at the leading edge of the sheet and for holding the sheet at a trailing edge thereof, rotating sprockets over which the chains are disposed and coaxially revolving supporting elements for the sheet. The supporting elements are disposed between the rotating sprockets and are in rolling contact with the circumferential surface of the cylinder. Coaxially revolving suction grippers are provided between the sprockets for holding the sheet at the trailing edge thereof. An actuating device is provided for opening and closing the grippers. A drive is provided for the cylinder and the rotating sprockets. Gripper pads and gripper tips are provided for the grippers for the trailing edge of the sheet. The grippers for the trailing edge, in the opened condition thereof, are able to run past the cylinder. The gripper pads and the gripper tips of the grippers for the trailing edge lie underneath a path described by the sheet held on the circumferential surface. The grippers for the trailing edge are closable in a rotational angle region wherein the chains run off the sprockets assigned to the cylinder.

In accordance with another feature of the invention, the sheet-conveying device further includes radially movable suction grippers disposed in circumferential direction in the vicinity of the gripper pads for the trailing edge and, outside the contact region with the cylinder, being radially higher than the gripper pads for the trailing edge.

In accordance with a further feature of the invention, the chains unwound at the sprockets have a length less than the sheet length maintained between the grippers for the leading edge and the radially movable suction grippers.

In accordance with an added feature of the invention, the sheet-conveying device further includes revolving support elements for the sheet and, for chains having polygon-type links, the pitch circle diameter of the sprockets is at most equal to the diameter of the revolving supporting elements.

In accordance with an additional feature of the invention, the sheet-conveying device further includes actuating elements for circumferentially adjusting the radially movable suction grippers.

In accordance with yet another feature of the invention, the actuating elements are piezoelectric actuators for effecting the circumferential adjustment.

In accordance with yet a further feature of the invention, the sheet-conveying device further includes a suction gripper bar whereon the radially movable suction grippers are disposed. The actuating elements are independently controllable for acting upon both sides of the suction gripper bar.

In accordance with a concomitant feature of the invention, the sheet-conveying device further includes radially movable suction grippers disposed in circumferential direction in the vicinity of the gripper pads for the trailing edge. The grippers for the trailing edge are closed in a rotational angle of the sprockets wherein the circular path of the surface of the suction grippers intersects the path of the gripper pads for the trailing edge.

Thus, according to the invention, trailing edge grippers which are fixed to a chain conveyor are led in opened condition past a cylinder from which a sheet is to be picked up. In this regard, the gripper pads and gripper tips for the trailing edge lie outside a path described by the sheet held on the circumferential surface of the cylinder. This ensures that the trailing edge grippers can pass the closed circumferential surface of the adjacent cylinder without collision. The trailing edge grippers are closed only in a rotational angle region of sprockets wherein the revolving path of the gripper pad intersects the radius of the crown line of the suckers.

In order to remove a sheet from the cylinder, suction grippers are provided which revolve with the sprockets of the chain conveyor and which pick up the sheet at the trailing edge thereof in the vicinity of the transfer center line. In order for the sheet to be picked up reliably and reproducibly by the suction grippers, supporting elements having supporting surfaces are provided, which press the sheet onto the circumferential surface of the cylinder. This means that a sheet is still held on the circumferential surface of the cylinder by the contact surface of the supporting surface when the suction grippers are just touching the sheet. In order to be able to pick up a sheet reliably from a cylinder, the suction grippers are forcibly moved against the trailing edge of the sheet, by making the radius of the suction grippers larger than the radius of the supporting surfaces. The suction grippers are disposed in such a way that they can move radially, with the suction grippers moving out to the original height thereof again after leaving the region of contact with the adjacent circumferential surface of the cylinder.

If a sheet is conveyed at the leading edge and at the trailing edge thereof, a minimum dimension for a sheet sag is required, for example because of one-sided action using a dryer. The device offers the possibility of adjusting the suction grippers in the circumferential direction by actuators, in order to set the sheet sag to a desired dimension. If two actuators acting upon a suction gripper bar are differently driven, the suction gripper bar can be set obliquely. Therefore, any desired positional corrections of a sheet can be performed as it is conveyed through a printing press, in order for example to effect compensation for a skewed position on front guides or for the diagonal register. Rotary transformers are provided for the power supply to the actuators. The position of the suction gripper bar can be regulated, for which purpose sensors can be disposed that supply signals relating to the current position of the sheet in the transfer center line on the cylinder and of the suction gripper bar.

A further possibility of obtaining a desired sheet sag is provided by the configuration of the pitch circle diameter of the sprockets and the chain pitch in relation to the diameter of the circumferential surface of the adjacent cylinder. In this regard, it is important that the length of the chains unwound from the sprockets be smaller than the sheet length in the same rotational angle region.

Other features which are considered as characteristic for the invention are set forth in the appended claims.

Although the invention is illustrated and described herein as embodied in a device for conveying a sheet through a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
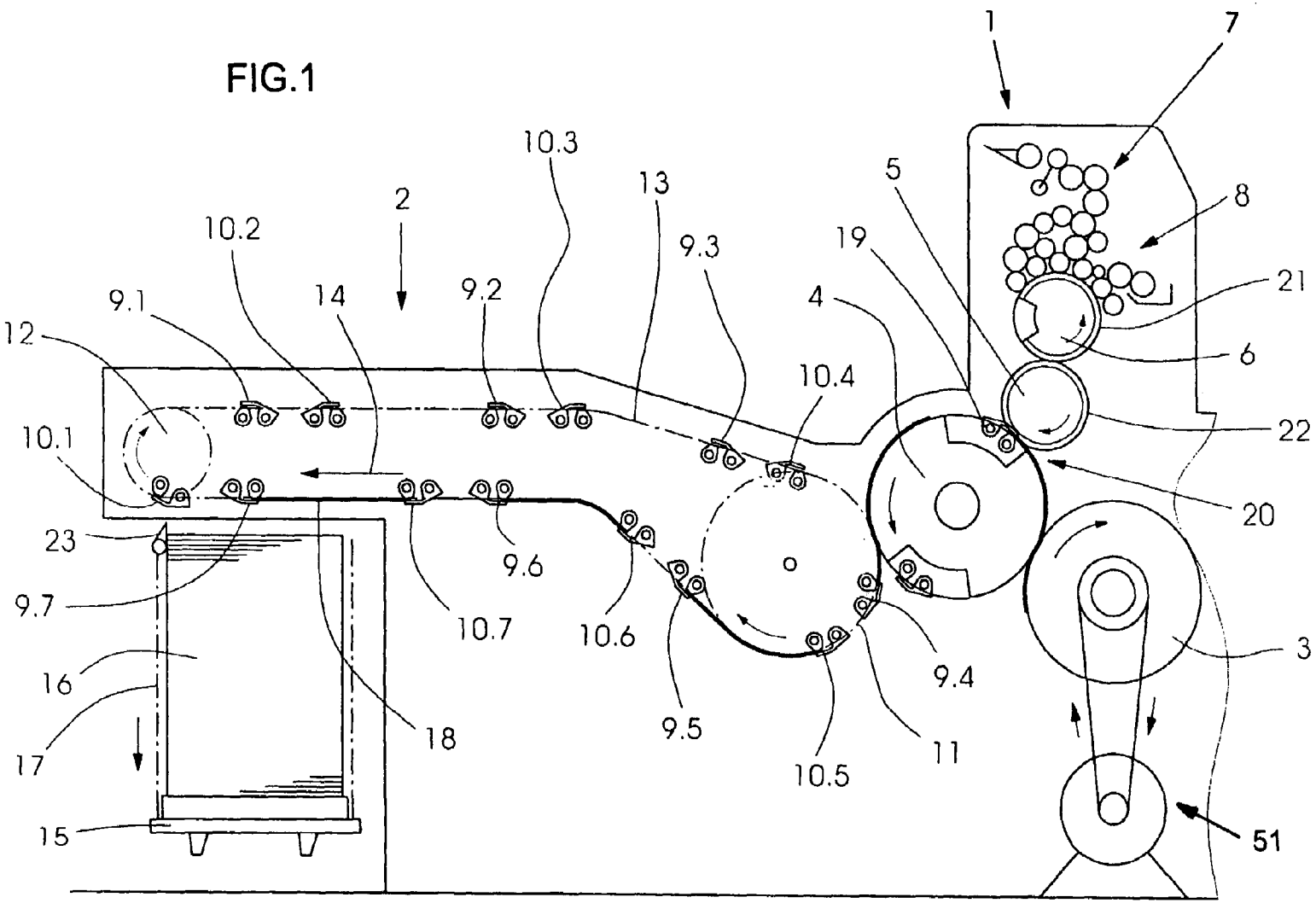
FIG. 1 is a fragmentary, diagrammatic, side-elevational view of a delivery of a printing press having a chain gripper system.

Referring now to the figures of the drawings in detail and first, particularly, to FIG. 1 thereof, there is seen a last printing unit 1 of a sheet-fed printing press, with a delivery 2 disposed downstream therefrom. The printing unit 1 has a sheet transport drum 3, an impression cylinder 4, a transfer cylinder 5 and a plate cylinder 6. Rollers of an inking unit 7 and a dampening unit 8 are associated with the plate cylinder 6. The delivery 2 includes a chain gripper system having a multiplicity of leading edge grippers 9.1 to 9.7 and trailing edge grippers 10.1 to 10.7, which are fixed to gripper bars. The gripper bars are connected to endless chains, which are disposed over sprockets 11 and 12 and guided in chain paths or tracks 13. At an end of lower runs of the chain paths 13, in a conveying direction represented by an arrow 14, a stacking or pile table 15 is provided, whereon a sheet pile or stack 16 is disposed. The stacking table 16 is lowerable by a chain mechanism 17 in accordance with the progress or advancement of production.

Sheets 18 are conveyed by the sheet transport drum 3 from the preceding printing unit to the impression cylinder 4. On the impression cylinder 4, the sheets 18 are held in grippers 19 and are guided through a printing nip 20 between the transfer cylinder 5 and the impression cylinder 4. A printing form 21 stretched out on the plate cylinder 6 is inked in accordance with an image with the aid of the dampening unit 8 and the inking unit 7. The transfer cylinder 5 has a rubber-elastic or resilient covering 22, with which the printing ink on the printing form 21 is transferred to the sheet 18. In the delivery 2, the sheets 18 are picked up at the leading edge thereof by the leading edge grippers 9.1 to 9.7, with the trailing edge of the sheets 18 being held by the trailing edge grippers 10.1 to 10.7. Shortly upstream of the pile or stack 16, the respective grippers 9.1 to 9.7 and 10.1 to 10.7 are opened, so that a respective sheet 18 falls onto the pile or stack 16. A leading edge stop 23 limits movement in the conveying direction represented by the arrow 14, of the sheet 18 which has been allowed to fall.

Figure 2:
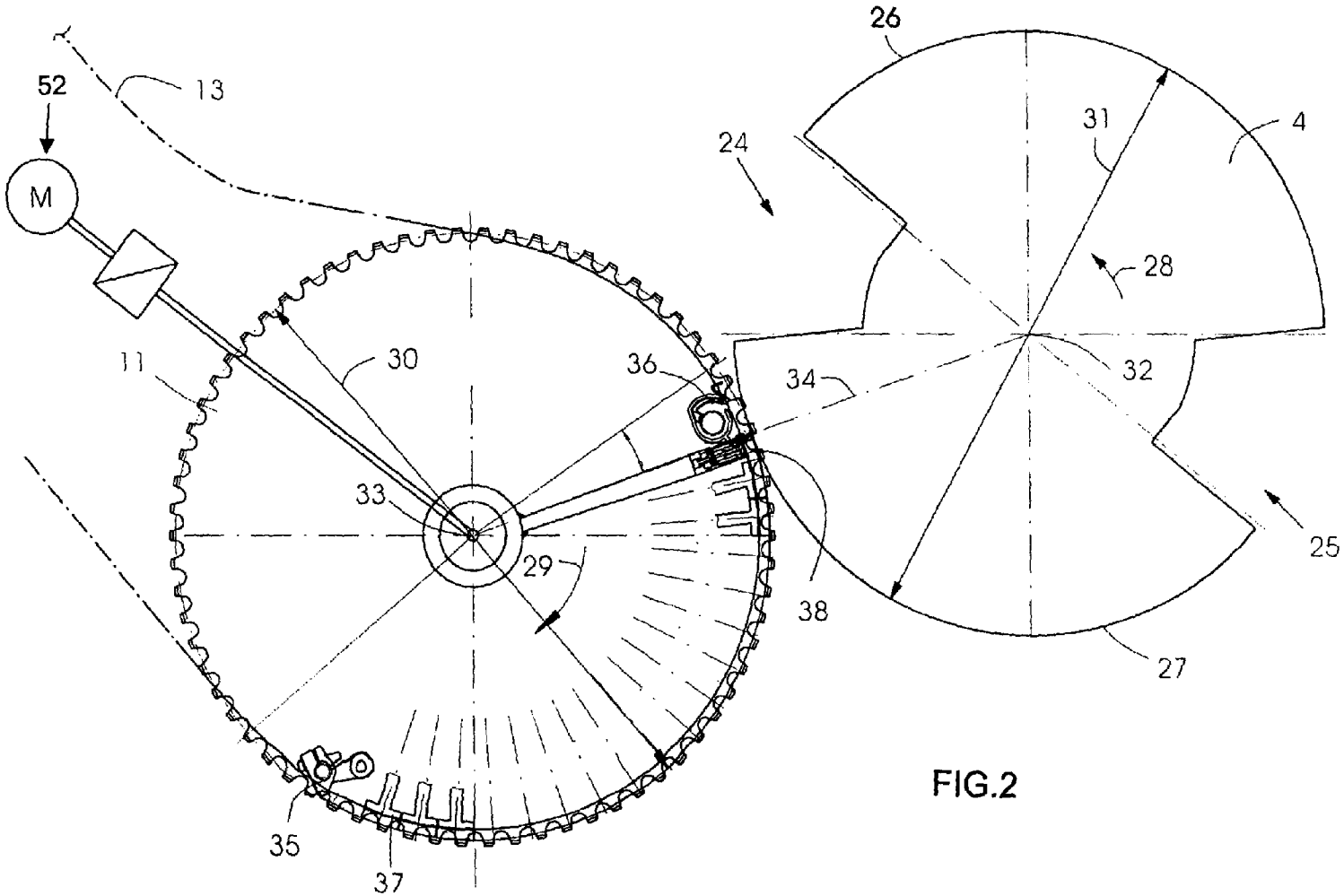
FIG. 2 is an enlarged, fragmentary view of FIG. 1 diagrammatically illustrating the sheet transfer between an impression cylinder of the printing press and the chain gripper system.

In FIG. 2, the elements for conveying a sheet 18 from the impression cylinder 4 onto the leading edge grippers 9.1 to 9.7 and the trailing edge grippers 10.1 to 10.7 are illustrated in greater detail. The cylinder 4 which is double the size, i.e., has twice the diameter, of the printing unit cylinders, i.e formed with two channels 24 and 25, wherein the grippers 19 shown in FIG. 1 are arranged on gripper bare. These gripper bars extend over the width of a sheet 18 which is held at the leading edge thereof. The impression cylinder 4 has two circumferential surface segments 26 and 27, whereon, respectively, a sheet 18 lies during conveyance. The length of the circumferential surface segments 26 and 27 in the circumferential direction corresponds to the maximum length of a sheet 18 to be conveyed. The impression cylinder 4 and the sprockets 11 are driven synchronously in the directions of the arrow 28 and 29, respectively by a drive 51. The pitch circle diameter 30 of the sprockets 11, and the diameter 31 of the impression cylinder 4 are of approximately equal length. A connecting line between the respective axes 32 and 33 of the impression cylinder 4 and the sprocket, 11 forms a transfer center line 34. In a direction perpendicular to the plane of the drawing of FIG. 2, an intersection region runs between the circular path of the circumferential surfaces 26 and 27 and a cylinder to which the pitch circles of the sprockets 11 belong. The intersection region and the transfer center line 34 are perpendicular to one another. The leading edge grippers 9.1 to 9.7 and the trailing edge grippers 10.1 to 10.7 are arranged at the width of the format on gripper bars 35 and 36, which are fixed to separate synchronously revolving chains. The spaced distance between the leading edge grippers 9.1 to 9.7, on the one hand, and the trailing edge grippers 10.1 to 10.7, on the other hand, is adjustable by shifting or displacing the phases of the chains with respect to the sheet length. Between the leading edge gripper bar 35 and the trailing edge gripper bar 36, supporting elements 37 for a sheet 18 are arranged on the axis 33, revolving with the sprockets 11. The supporting elements 37 carry the sheet 18 at the print-free marginal edges thereof. For the purpose of effecting adjustments to the sheet width, the supporting elements 37 are displaceable on the axis 33. The number of supporting elements 37 in the circumferential direction is variable in accordance with the sheet length. Furthermore, suction grippers, which are arranged on a suction gripper bar 38, revolve with the supporting elements 37. The suction gripper bar 38 is assigned to the trailing edge gripper bar 36 with regard to the rotational position about the axis 33. The suction grippers pick up or accept the sheet 18 at the trailing edge thereof.

The leading edge gripper bar 35 dips into the channel 25 of the impression cylinder 4 as the gripper bar 35 passes the transfer center line 34. Due to the presence of the channels 24 and 25, there is no risk of collision between the leading edge grippers 9.1 to 9.7 and the impression cylinder 4 at this point. On the other hand, for the trailing edge grippers 10.1 to 10.7, precautions must be taken to ensure that the trailing edge grippers 10.1 to 10.7 pass the circumferential surfaces 26 and 27 without contact. For this purpose, the trailing edge grippers 10.1 to 10.7 are opened at a correct time before reaching the transfer center line 34, to such an extent that the trailing edge gripper bar 36 can pass without collision.

Figure 3:
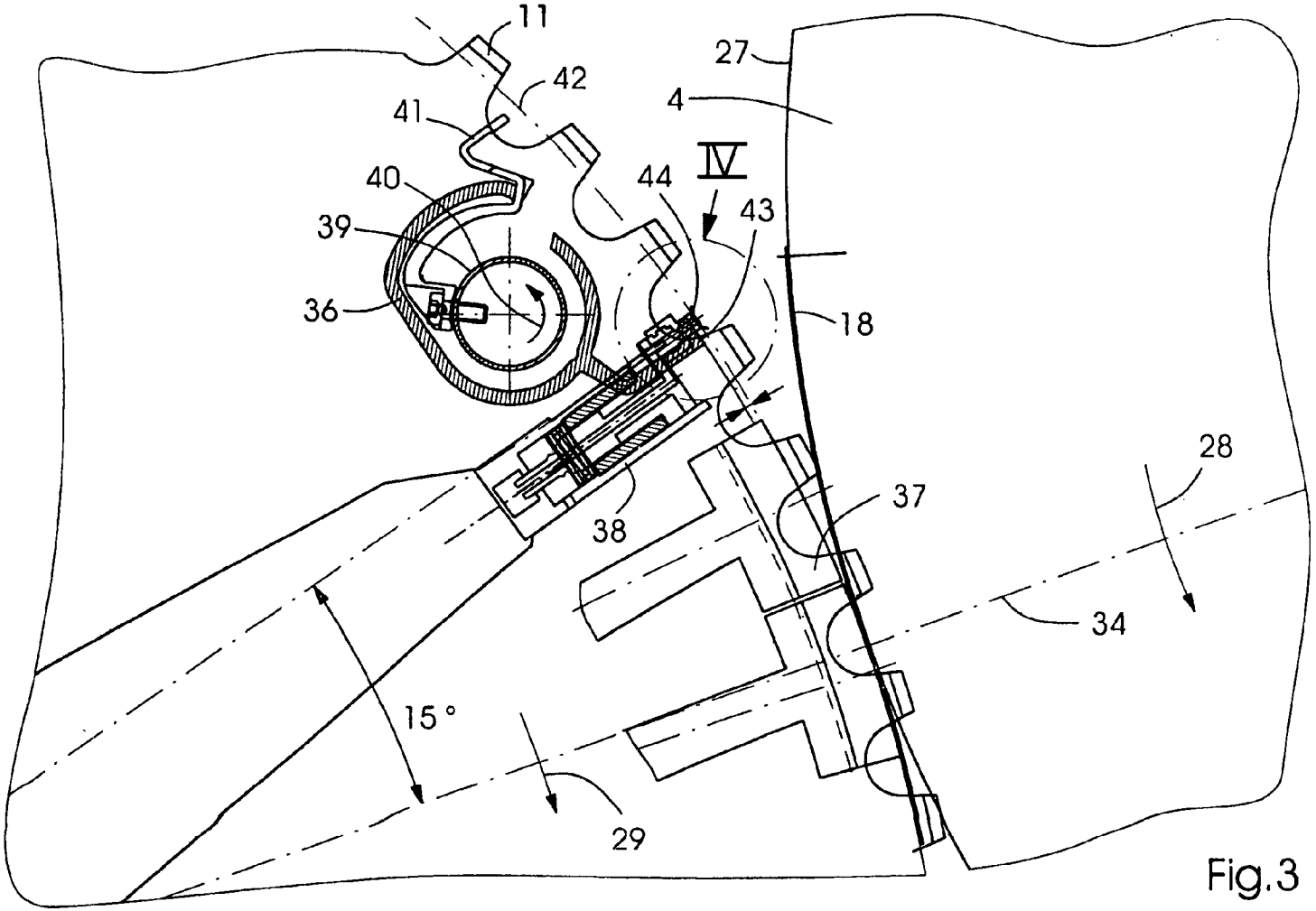
FIG. 3 is an enlarged, fragmentary view of FIG. 2 in a phase fifteen degrees before a sheet trailing edge is picked up.

FIG. 3 shows the sprockets 11 in a rotational position of about 15 degrees before the transfer center line 34. Gripper fingers 41 are pivoted back to such an extent that they lie reliably under a path 42 described by the supporting surface of the supporting elements 37, by rotating a gripper shaft 39 in a direction represented by an arrow 40. The gripper pad 43 is also located deeper in the radial direction than the path 42. The supporting elements 37 extend in the circumferential direction to as far as the suction gripper bar 38, so that the sheet 18 remains held by the supporting surface when suckers 44 of the suction grippers 38 just touch the sheet 18.

Figure 4:
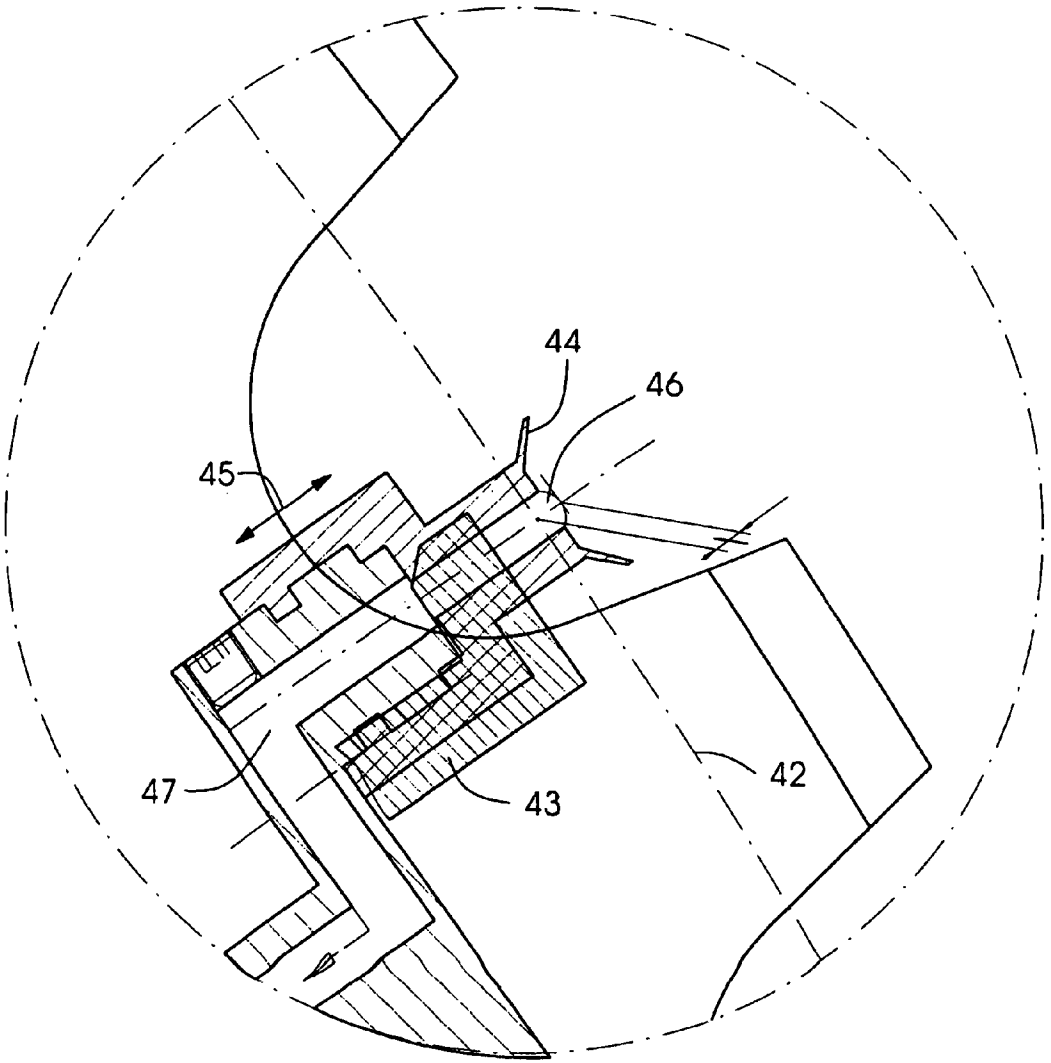
FIG. 4 is an enlarged, fragmentary view of FIG. 3 showing a dot-dash encircled region relating to the radial position of suction grippers.

FIG. 4 illustrates a detail IV of FIG. 3 in an enlarged view. In order to achieve a reliable takeover or pick-up of the sheet 18 at the trailing edge thereof, the radial height of the suckers 44 is located a distance x above the path 42 of the supporting elements 37. The suckers 44 are displacable in the radial direction represented by a double-headed arrow 45 by actuating elements 52. The suction openings 46 of the suckers 44 are connected to a vacuum source via a duct 47.

Figure 5:
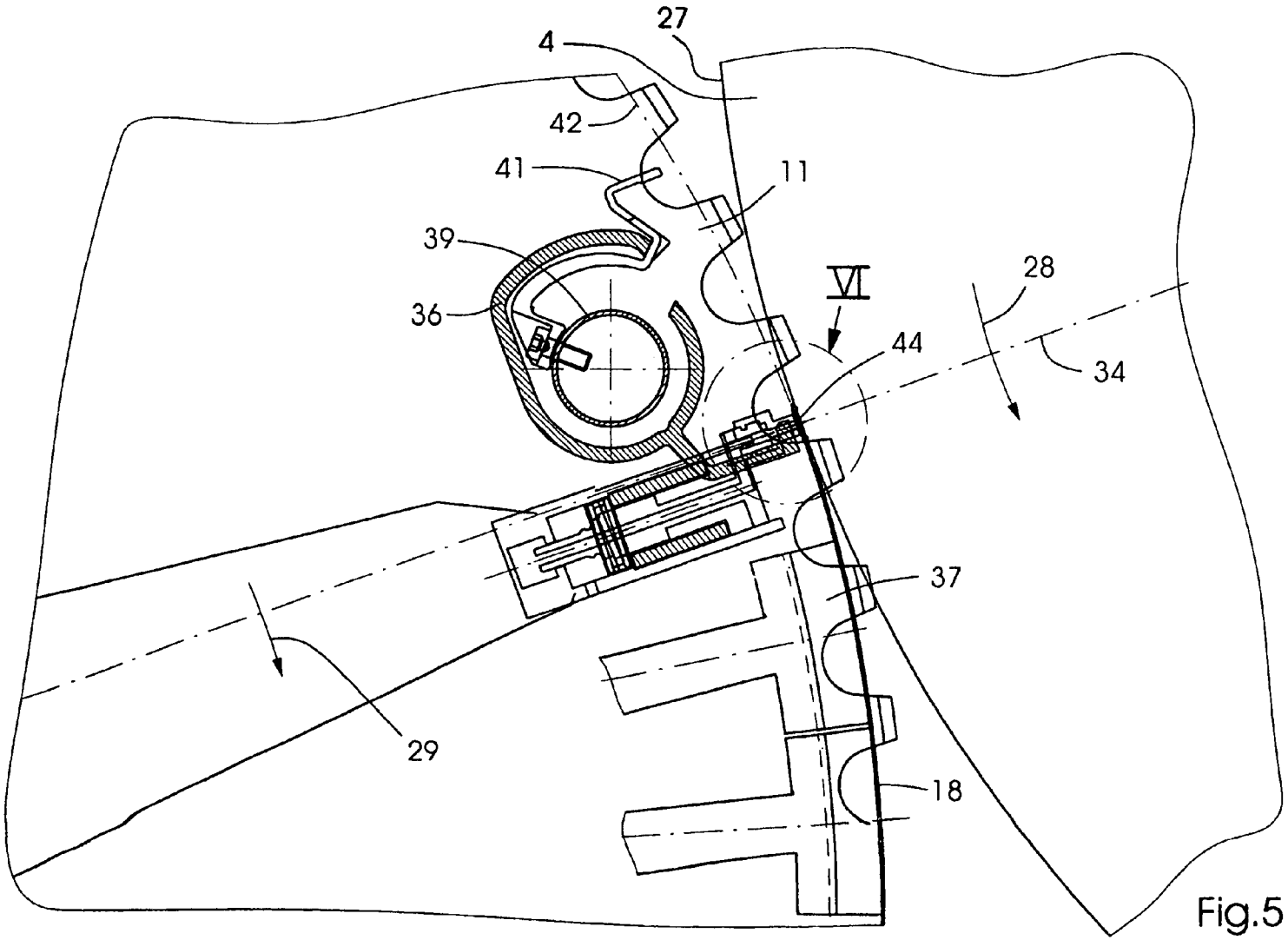
FIG. 5 is an enlarged, fragmentary view of FIG. 2 in a phase wherein a sheet trailing edge is being picked up by suction grippers.
Figure 6:
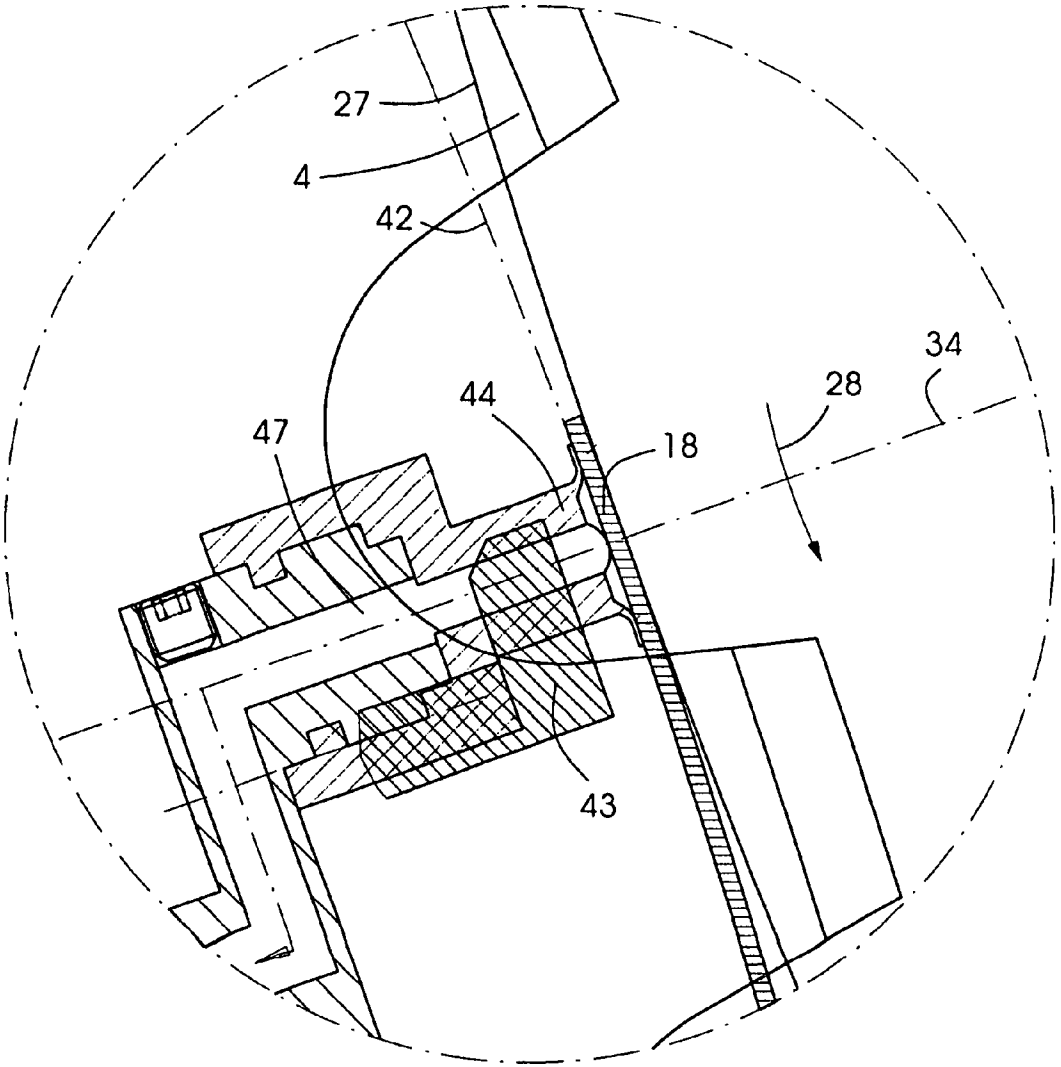
FIG. 6 is an enlarged, fragmentary view of FIG. 5 showing a dot-dash encircled region wherein the suction grippers are in contact engagement with the trailing edge of a sheet.

In FIG. 5 and in a portion VI thereof shown in an enlarged view in FIG. 6, the suckers 44 are illustrated exactly on the transfer center line 34. In this position, the gripper fingers 41 remain pivoted away from the gripper pads 43. The suckers 44 pick up the sheet 18 at the trailing edge thereof. As the sprockets 11 continue to rotate, the sheet 18 leaves the circumferential surface 27 of the impression cylinder 4 and is carried at the marginal edges thereof by the supporting elements 37. The suckers 44 are pushed-in radially by the respective contact thereof with the sheet 18 and the circumferential surface 27 on the transfer center line 34. After leaving the transfer center line 34, the suckers 44 move back to the original radial height or level thereof again, which they inherently had in the region before the transfer center line 34. Therefore, in the region after the transfer center line 34, a difference in height exists for the trailing edge between the radial level of the suckers 44 and the gripper pad 43.

Figure 7:
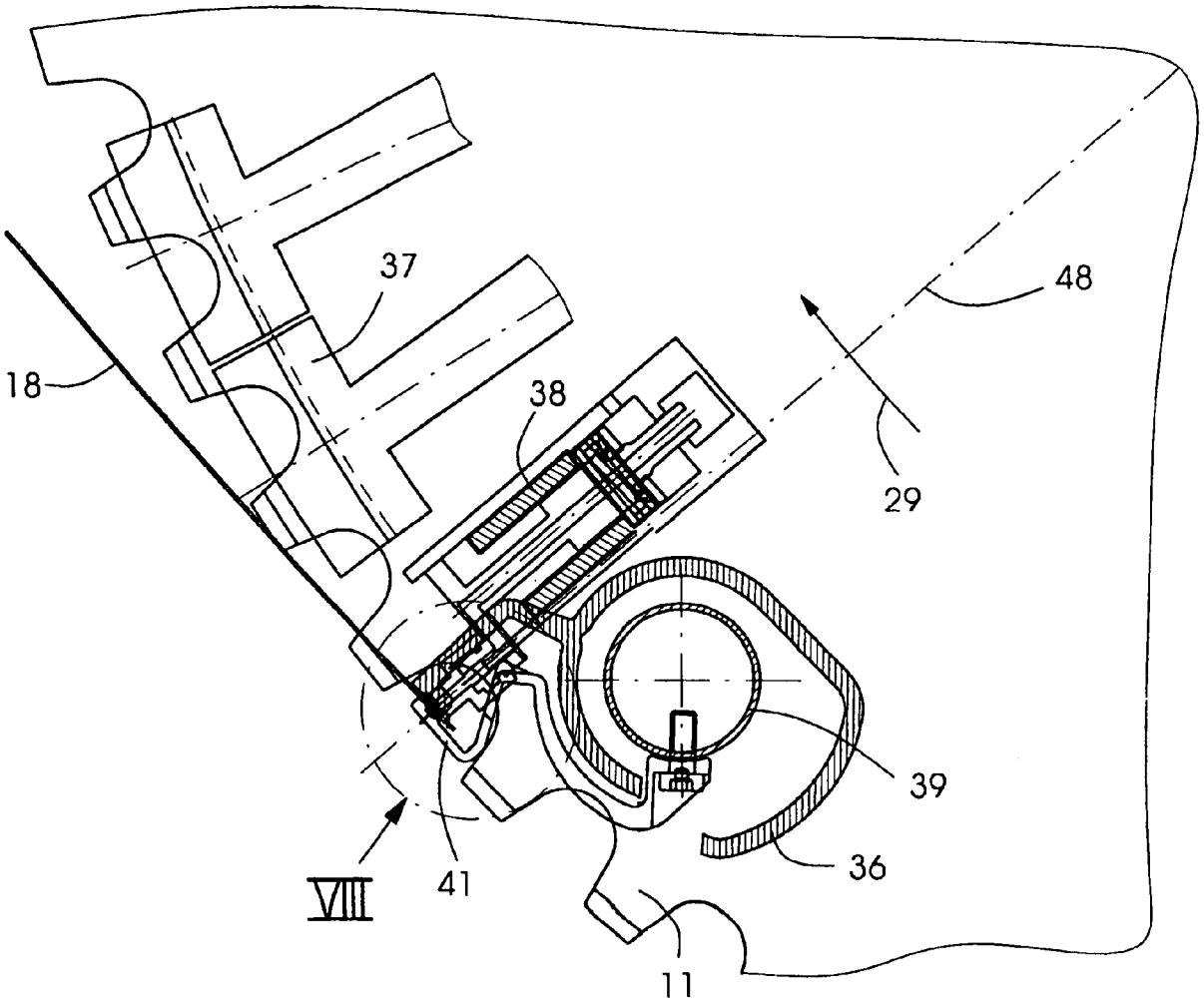
FIG. 7 is an enlarged, fragmentary view of FIG. 2 in a phase 195 degrees after a sheet trailing edge has been picked up.
Figure 8:
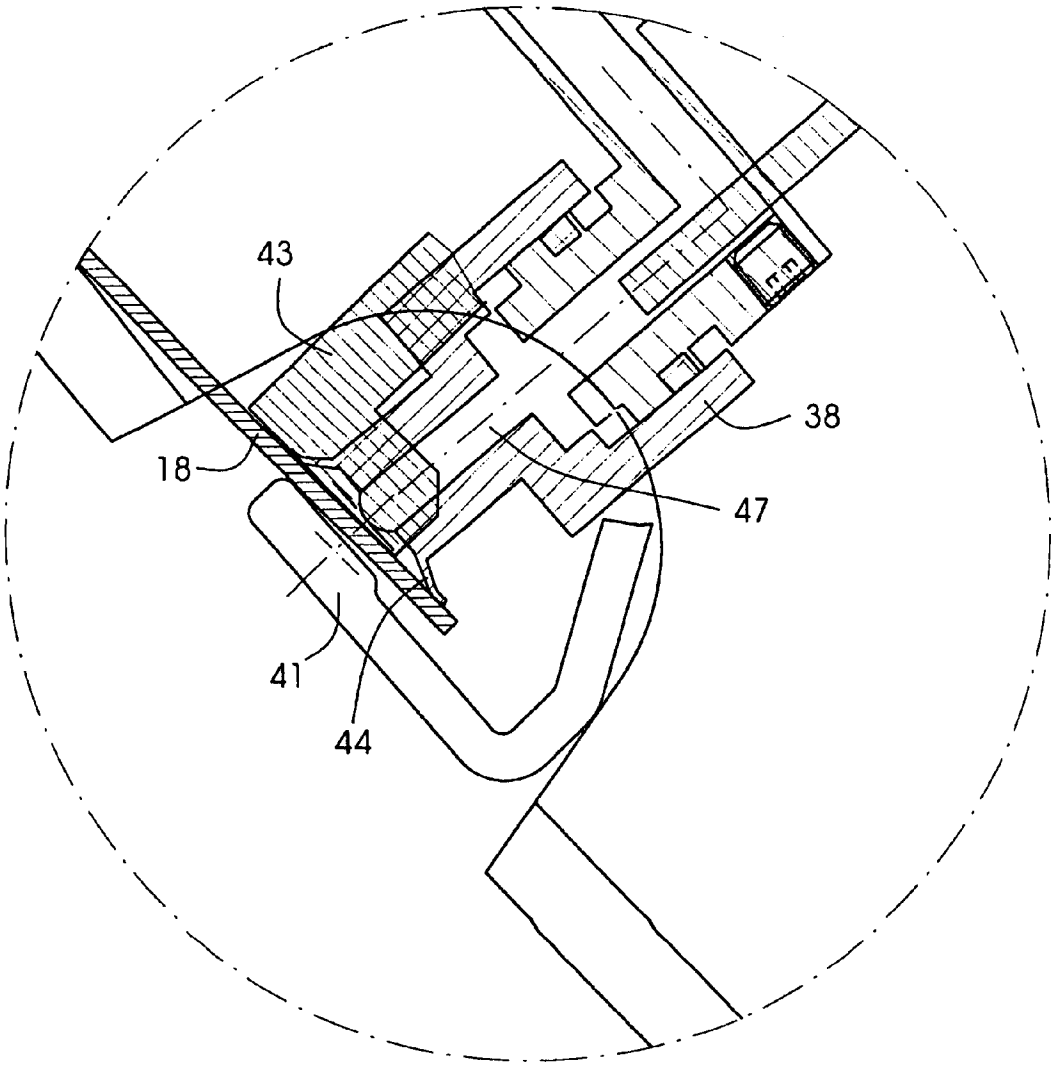
FIG. 8 is an enlarged, fragmentary view of FIG. 7 showing a dot-dash circle wherein the sheet trailing edge is picked up by trailing edge grippers of the chain gripper system.

FIG. 7 and a portion XIII thereof shown in an enlarged view in FIG. 8 show the acceptance or pick-up of the trailing edge of the sheets 18 by the suction grippers 44 into the trailing edge grippers 10.1 to 10.7. In the region wherein the chains run off the sprockets 11, the gripper pads 43 for the trailing edge of the sheet 18 come close to the radial level of the suckers 44. In this region, there is necessarily a point at which the path of the gripper pads 43 intersects the circular path of the surface of the suckers 44. The connecting line between this point and the axis 3 of the sprockets 11 results in a further transfer center line 48. On this transfer center line 48, the trailing edge of the sheet 18 is transferred to the trailing edge grippers 10.1 to 10.7. The respective trailing edge gripper 10.1 to 10.7 is closed on the transfer center line 48, so that the trailing edge of the sheet 18 is held between the gripper fingers 41 and the gripper pads 43. The vacuum to the suckers 44 is switched off, so that the suckers 44 release the sheet 18, or the vacuum remains switched on and the sheets 18 are torn from the suckers 44. The sheet 18 is conveyed onto the pile or stack 16 in accordance with the chain track 13, held at the leading edge and trailing edge of the sheet 18.

Assuming a revolving diameter d of the supporting elements 37, a pitch circle diameter $d_0$ of the sprockets 11 and a length 1 of the sheets 18, a sheet shortening or contraction a is given by:

$$a = 1\left(1 - \frac{d_0}{d}\right).$$

From this sheet shortening, for a sheet with low stiffness and low sag, a maximum sheet sag $h_{max}$ and a small sag result:

$$h_{\max} = \sqrt{\frac{3}{8}(a \cdot 1 - a^2)}\,.$$

A sheet sag is required in order to be able to hold a sheet 18 with the given gripper holding forces, for example if one side is subjected to air by a dryer. The root function results in a sensitive relationship between the shortening or contraction a and the sheet sag $h_{max}$.

The shortening or contraction a and, therefore, the sheet sag $h_{max}$ can be greatly affected due to inaccuracies in the sheet position on a circumferential surface segment 26, 27. Therefore, in one alternate or varying embodiment of the invention, provision is made for actively influencing the sheet sag $h_{max}$. It is possible to exert an influence in the rotational angle region of the sprockets 11 where a sheet 18 is held only by the suckers 44, i.e., after the takeover or pick-up from the impression cylinder 4 until the instant of time of the transfer to the trailing edge gripper bar 36. One possible way of changing the position of the trailing edge of the sheets 18 in relation to the leading edge is by the use of actuators, in particular piezoelectric actuators, which are disposed on both sides between the suction gripper bar 38 and the holders of the suction gripper bar 38 on the axis 33. if the actuators are driven simultaneously, the suction gripper bar 38 experiences a pure circumferential adjustment. If the actuators are driven differently, a skewed position of the suction gripper bar 38 results. Therefore, any desired positional corrections of the sheet 18, in particular compensation for a skewed position of front guides in the feeder of the printing press, and corrections of settings of the diagonal register, can be made. The position of the suction gripper bar 38 can be regulated if position sensors are provided, which are directed towards the sheet 18 on both sides of the sheet path on the transfer center line 34. In addition, the current position of the suction gripper bar 38 in the circumferential direction of the sprockets 11 can be determined by distance sensors. The power for actuating the actuators is made available via rotary transformers on the axis 33.

The foregoing considerations relating to the sheet sag $h_{max}$ assume that the pitch of the sprockets 11, 12 is so small that the chains have no disruptive polygon effect. A further variable having an influencing effect upon the sheet sag results if the polygon effect is taken into account in the case of large-link chains in the delivery 2. In the case of a chain which has links disposed around a sprocket 11 forming a polygon, a sag will also be established if the pitch circle diameter of the sprockets 11 has the same diameter as the circumferential surface segments 26, 27 of the impression cylinder 4. The resultant sheet sag depends in this case upon the chain pitch. If a sprocket 11 has a pitch circle diameter $d_0$, a number of teeth z and a chain pitch t, then:

$$t = d_0 \cdot \sin\left(\frac{180°}{z}\right).$$

The sheet shortening or contraction $a_p$ with the polygon effect taken into account is calculated as:

$$a_p = l \cdot \left(l - z \cdot \left(\frac{t}{\pi \cdot d}\right)\right),$$

from which a corresponding sheet sag $h_{max,p}$ results from the hereinafore-mentioned relationship:

$$h_{\max,p} = \sqrt{\frac{3}{8}(a_p \cdot l - a_p^2)}\,.$$

This consideration assumes that the sheet 18 lies at the radial height of the supporting elements 37. It is possible to disregard the radial heights of the suckers 44 and of the gripper pad for the leading edge and the trailing edge 9.1 to 9.7 and 10.1 to 10.7.

This application claims the priority, under 35 U.S.C. § 119, of German Patent Application 103 58 171.5, filed Dec. 12, 2003; the entire disclosure of the prior application is herewith incorporated by reference.

We claim:

1. A device for conveying a sheet through a printing machine, comprising:

a cylinder having a circumferential surface;

grippers arranged in a channel formed in the cylinder for holding the sheet at a leading edge thereof;

a chain conveyor with grippers fixed to endless chains for holding and picking up the sheet from the cylinder at the leading edge of the sheet and for holding the sheet at a trailing edge thereof;

rotating sprockets over which the chains are disposed;

coaxially revolving supporting elements for the sheet, the supporting elements being arranged between the rotating sprockets and being in rolling contact with the circumferential surface of the cylinder; and coaxially revolving suction grippers provided between the sprockets for holding the sheet at the trailing edge thereof;

an actuating device for opening and closing the grippers; and a drive for the cylinder and the rotating sprockets, and further including gripper pads and gripper tips for the grippers for the trailing edge of the sheet;

the grippers for the trailing edge, in the opened condition thereof, being able to run past the cylinder;

said gripper pads and said gripper tips of the grippers for the trailing edge lying underneath a path described by the sheet held on the circumferential surface;

the grippers for the trailing edge being closable in a rotational angle region wherein the chains run off the sprockets assigned to the cylinder; and radially movable suction qrippers disposed in a circumferential direction in vicinity of said gripper pads for the trailing edge, outside the contact region with the cylinder and being radially higher than said gripper pads for the trailing edge.

2. The sheet-conveying device according to claim 1, wherein the chains unwound at the sprockets have a length less than the sheet length maintained between the grippers for the leading edge and said radially movable suction grippers.

3. The sheet-conveying device according to claim 1, further comprising revolving support elements for the sheet:

and, for chains having polygon-type links, the pitch circle diameter of the sprockets is at most equal to the diameter of said revolving supporting elements.

4. The sheet-conveying device according to claim 1, further comprising actuating elements for circumferentially adjusting said radially movable suction grippers.

5. The sheet-conveying device according to claim 4, wherein said actuating elements are piezoelectric actuators for effecting the circumferential adjustment.

6. The sheet-conveying device according to claim 4, further comprising a suction gripper bar whereon said radially movable suction grippers are arranged;

said actuating elements being independently controllable for acting upon both sides of said suction gripper bar.

7. The sheet-conveying device according to claim 1, further comprising:

radially movable suction grippers disposed in circumferential direction in vicinity of said gripper pads for the trailing edge; and the grippers for the trailing edge being closed in a rotational angle of the sprockets wherein the circular path of the surface of said suction grippers intersects the path of the gripper pads for the trailing edge.

* * * * *